US005252091A

United States Patent [19]

Fujita et al.

[11] Patent Number: 5,252,091

[45] Date of Patent: Oct. 12, 1993

[54] BRANCH CONNECTOR

[75] Inventors: Yoshinori Fujita; Yukimitsu Hattori, both of Yokkaichi, Japan

[73] Assignee: Sumitomo Wiring Systems, Ltd., Mie, Japan

[21] Appl. No.: 913,458

[22] Filed: Jul. 15, 1992

[30] Foreign Application Priority Data

Jul. 31, 1991 [JP] Japan ..... 3-191731

[51] Int. Cl.[5] ..... H01R 13/00

[52] U.S. Cl. ..... 439/499

[58] Field of Search ..... 439/492–499

[56] References Cited

U.S. PATENT DOCUMENTS

| | | | |
|---|---|---|---|
| 4,030,799 | 6/1977 | Venaleck | 439/499 |
| 4,181,395 | 1/1980 | Grabowski | 439/499 |
| 4,606,595 | 8/1986 | Dola | 439/499 |
| 4,650,925 | 3/1987 | Coldren | 439/499 |
| 4,674,819 | 6/1987 | Fujitani | 439/499 |

*Primary Examiner*—Joseph H. McGlynn

*Attorney, Agent, or Firm*—Sughrue, Mion, Zinn Macpeak & Seas

[57] ABSTRACT

A single connector is respectively mounted at the tip ends of each of a plurality of branch wire groups to be branched and which are pulled out from optional positions of one wire harness. A connector receiver, composed of a lower case an upper case is mounted in a further wire harness composed of a flexible printed circuit with the branch circuit being secured at a necessary position. The lower case supports the wire harness and the further upper case is mounted detachably in the lower case and is provided with a connector inserting portion, with the single connector being detachably inserted therein. Accordingly, the wire harness can be made lighter in weight and can save space, and the circuit in the branch connector can be easily changed.

5 Claims, 16 Drawing Sheets

BRANCH CONNECTOR

BACKGROUND OF THE INVENTION

The present invention generally relates to a branch connector which is provided in an intermediate portion of a wire harness for connecting electric wiring parts and so on for use in motorcars and which connects together electric wires in the wire harness so as to form a branch circuit, and more particularly, to a branch connector to be used when the wire harness has been formed of an FPC (flexible printed circuit).

Conventionally, this type of wire harness includes a main line 1 having many wires being bundled together, a branch line 2 which is branched in accordance with the mounting position of each of the battery powered car parts from an intermediate place of the main line 1, and a terminal 3 which is connected with the tip end of each branch wire, with these terminals being connected with each of a plurality of electric wiring parts (not shown), as shown in FIG. 22.

An operation of branching a branch line 2 from the desired position along the main line 1 and an operation of mounting the proper type of terminal 3 to the tip end of the branch line 2 must be carried out each time for each of the electric wiring parts. Accordingly, operational troubles often occur and, parts management also becomes complicated.

Furthermore, as the number of manual operations is large, the connection becomes uncertain. Troubles such as connection errors, disconnection, shorts, and so on are likely to be caused, thus resulting in inspection/-repairs which causes problems.

In order to remove the above described disadvantages, Japanese Utility Model Publication No. 61-38350, Japanese Patent Application Publication No. 61-45575 and so on are proposed, where branch portions of the branch lines from the wire harness main line are concentrated in one location to simplify the wiring system so that the connecting operations may be easily effected quickly and positively.

In either of the apparatuses disclosed in the above described publications, a connector is respectively mounted on many electric wire groups taken out from one wire harness and connected with each other. Many connectors are accommodated in parallel relation within a joint block. Through a pressure contact terminal (Japanese Patent Application Publication No. 61-45575) or a bus bar (Japanese Utility Model Publication No. 61-38350), mounted on the case of the joint block, the above described connector is connected with the selected electric wire of the other wire harness so as to concentratively form a branch circuit.

A joint block for concentratively accommodating many connectors is provided, and the electric wires to be connected with each other are taken out from an electric wire bundle of a wire harness so as to form a branching circuit connected by the connector of the above described joint block. When the above case is compared with a case where the branch line is branched in accordance with each of the above described devices, the connecting operation can be collectively effected, with an advantage that an engagement operation of the whole wire harness becomes extremely easy.

In a wire harness with electric wires being bundled, it has considerable weight, and also, considerable space is necessary for the arrangement of the wire harness.

Because of the concentration of the connectors and the concentration of branch positions from the wire harness, a considerably unreasonable design may be required in the branching circuit design of the wire harness.

For example, the joint block is made large in size so as to concentratively accommodate the connectors, so that the mounting position of the joint block is restricted.

When the joint block is mounted on the car body, various restrictions are present with respect to the available space. When the space restrictions are due to the size of the joint block itself, the mounting position is extremely restricted. The joint block mounting position may be a considerable distance away from the arrangement position of the electric wiring parts to be connected with the branching circuit of the joint block, and also, the take-out position of the branch electric wire group from the wire harness main line may be a considerable distance away from the above described joint block mounting position.

In the above described case, the extra electric wires have to be used. The diameter of the wire harness has to be increased correspondingly, thus increasing the weight and cost. Further, the shape of the wire harness becomes complicated to lower the efficiency of the assembling operationality.

When the branch circuit is constructed with the joint block as described hereinabove, the circuit within the branch connector is difficult to change.

In a case of a device using the above described bus bar, it is necessary to change the arrangement of the terminals for connecting the electric wires. In a case of composing a circuit with the above described pressure contact terminals it is necessary to change the pressure contact terminals. It takes more time to pull out and replace the terminals or pressure contact terminals once mounted on a case. It is extremely difficult practically in terms of cost and so on.

SUMMARY OF THE INVENTION

Accordingly, the present invention has been developed with a view to substantially eliminate the above discussed drawbacks inherent in the prior art, and has as its essential object the provision of an improved branch connector.

Another important object of the present invention is to provide an improved branch connector which is adapted to make the weight of the wire harness itself lighter, the space smaller, and also, to simplify the connecting operation of the branch connector and to easily change the circuit construction of the branch connector.

In accomplishing these and other objects, the branch connector comprises at least a first wire harness which is composes of a flexible printed circuit (FPC), the first wire harness being provided with a connector receiver, and second wire harness with a single connector being respectively mounted on the tip ends of each of a plurality of branch line groups to be branched and which are taken out from an optional position. The above described connector receiver comprises a lower case for supporting the first wire harness, with the above described connector receiver being secured to a position where the branch circuit is necessary, and an upper case provided with a connector inserting portion which is detachably mounted on the lower case. The above described single connector is detachably inserted into the connector insertion portion. The connector receiver further comprises a pressure contact terminal previously mounted on the above described upper case, with one side portion thereof being projected into the above described connector inserting portion, for being connected with the branch line group of the second wire harness through the above described connector and also, another side portion thereof being connected with a lead wire portion of the first wire harness.

The above described upper case is provided with an upper connector engagement portion and a lower pressure contact terminal inserting portion partitioned off by a bulkhead portion provided in a hollow portion and a lower pressure contact terminal inserting portion. Pressure contact terminal inserting holes are drilled in parallel in the above described bulkhead portion, and an a FPC for circuit construction is disposed on the top face of the above described lower case. A contact portion on the upper side portion of the above described pressure contact terminal is inserted into the above described pressure contact terminal inserting hole so as to project the same into a connector inserting portion. A connection portion for connecting a lead wire of the first wire harness and a circuit contact portion to be connected with the circuit portion of the FPC for the above described circuit construction use are continuously formed in the pressure contact terminal inserting portion so as to connect one pressure contact terminal with the other pressure contact terminals through the FPC for circuit construction use.

The above described pressure contact terminal includes a tip end portion on the pressure contact terminal inserting portion side which is bent so as to form a connecting portion and also includes a bent circuit contact portion so that the lower side is convex shaped continuously with the connection portion. The above described connecting portion is connected with the lead wire portion of the first wire harness to be continuously grasped in a condition so as to be orthogonal to the above described pressure contact terminal insertion hole between the above described lower case and the upper case. The circuit contact portion projected to the lower face side through the hole portion provided in the first wire harness is guided into contact with the circuit portion of the FPC disposed on the top face of the above described lower case.

The above described pressure contact terminal forms, on the upper side of the tip end portion on the pressure contact terminal inserting portion side, a connecting portion composed of a flat face, and on the lower side thereof, a circuit contact portion composed of circular face. A pair of first wire harnesses are grasped, orthogonally to the above described pressure contact terminal inserting hole between the lower case and the upper case, and the lead wire portion is connected with the connecting portion of the above described pressure contact terminal in the tip end portion of the first wire harness, so as to being into contact the circuit contact portion of the pressure contact terminal with the circuit portion of the FPC circuit portion which is in turn disposed on the top face of the lower case.

The male shaped contact portion on the top side portion of the above described pressure contact terminal is inserted into the pressure contact terminal inserting hole so as to project the same into the connector inserting portion, and the tip end portion of the pressure contact terminal is bent onto one side in the pressure contact terminal inserting portion to form the connecting portion. The above described connecting portion is preferably connected in construction with the lead wire portion of the first wire harness to be grasped so as to be orthogonal to the above described pressure contact terminal inserting hole between the lower case and the upper case.

The above described upper case and the lower case may be integrally formed through a hinge having flexibility.

A first coupling portion is provided on the outer face of a case composed of an upper case or a lower case. A second coupling portion, for being detachably engaged, and mutually locked with the above described first coupling portion, is provided on the outer face of the case of a branch connector to be adjacently disposed, so that single connectors may be coupled together.

When the first wire harness with at least a connector receiver being provided on it, of the first and second wire harnesses as described hereinabove in the present invention, is composed of the FPC, the wire harness itself is made lighter in weight and requires less space.

Conventionally, the joint block with the connectors being concentratively accommodated is divided singly by connector, and the arrangement can be easily effected in a location necessary for branching with smaller size by the division, the unnecessary branch wires can be removed, the wire harness shape becomes simple so that the weight of the wire harness is made lighter, and the improvement in the operationality may be effected.

The FPC for circuit construction use is disposed in a lower case, and a circuit contact portion of a pressure contact terminal is guided into contact with the circuit portion provided on the circuit construction FPC. When one pressure contact terminal is adapted to be connected other pressure contact terminal, the circuit construction FPC is exchanged for a circuit construction FPC having a different circuit portion, so that the circuit construction within the branch connector can be changed.

When an upper case and a lower case for constructing a case of the branch connector is integrally formed through a hinge portion, an assembling operation of the wire harness is further simplified and the number of parts is reduced, and a cost reduction and so on can be effected.

When a coupling portion which can be detachably coupled with respect to each other is provided on a branch connector divided singly into the above described connector, the branch connector can be dispersed, coupled when necessary, and the degree of freedom in the design of the wire harness can be further increased.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
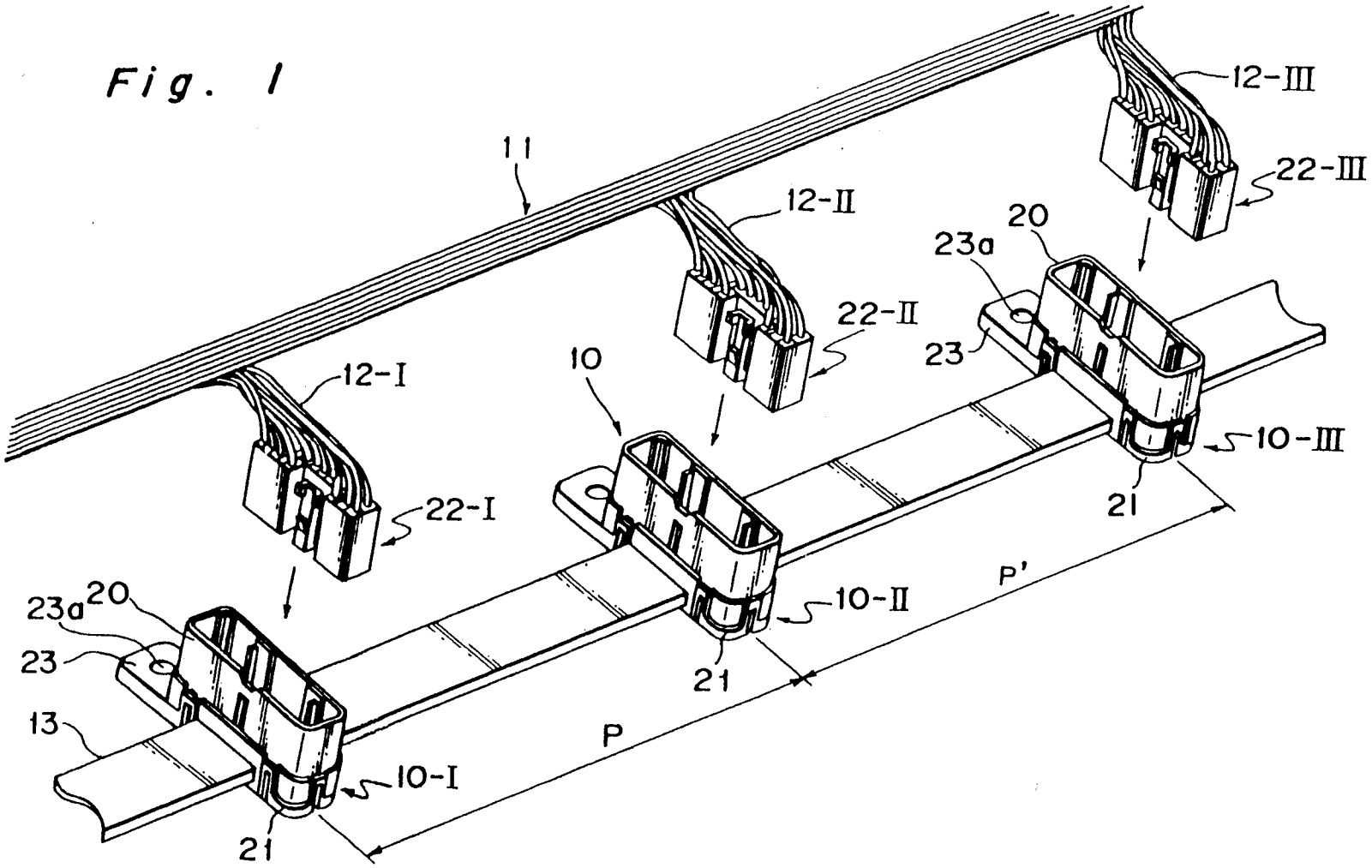
FIG. 1 is a perspective view showing a first embodiment of the present invention.
Figure 2:
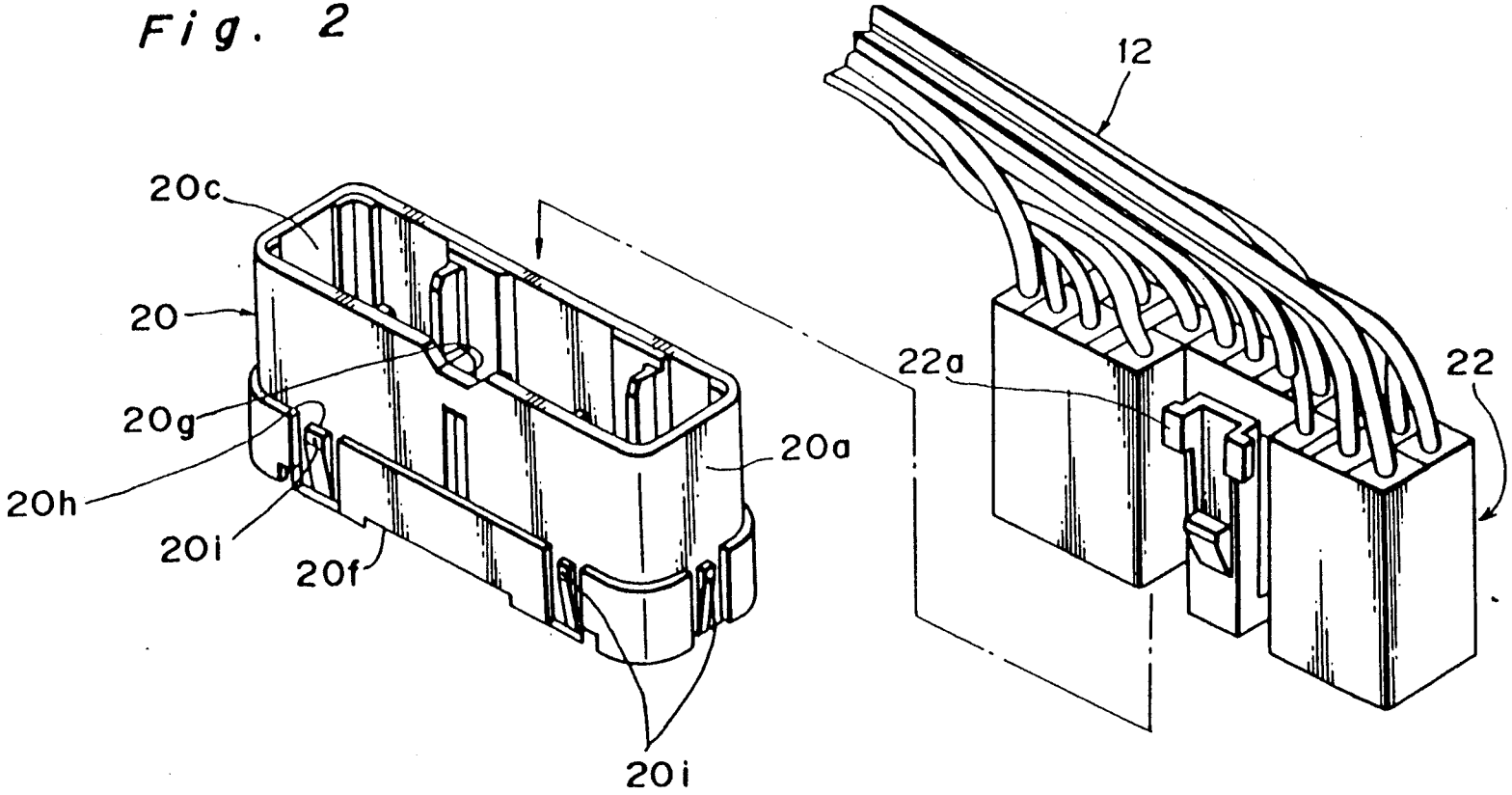
FIG. 2 is an exploded perspective view of essential portions of FIG. 1.

Before the description of the present invention proceeds, it is to be noted that like parts are designated by like reference numerals throughout the accompanying drawings.

The present invention will be described hereinafter in detail with reference to the drawings.

FIG. 1 through FIG. 10 show a first embodiment of the present invention. In the present embodiment, lead wire portions 15*a* through 15*f* of a first wire harness 13 composed of an FPC, as described later, are connected with a branch wire group 12 (12-I, 12-II, 12-III) drawn out from a second wire harness 11 of a normal type composed of electric wires to be connected with each of a plurality of electric wiring parts (not shown) being bundled through connector receivers 10 (10-1, 10-II, 10-III) and connectors 22 (22-I, 22-II, 22-III) for constructing a branch connector.

The second wire harness 11 is a normal type of wire harness constructed with electric wires to be connected with each of electric wiring parts (not shown) being bundled.

The first wire harness 13 is connected to a portion, with each of the electric wiring parts of the above described second wire harness 11, such as a power supply portion, an ignition switch (not shown) and so on being connected in common. The first wire harness 13 is composed of a flexible printed circuit (FPC) which is continuous in a lengthwise direction as shown in detail in FIG. 4 and FIG. 5. Namely, the first wire harness 13 has a plurality of linear copper leaf portions printed in parallel on the side of the top face 14*a* of a film 14 composed of a flexible material so as to form lead wire portions 15*a*, 15*b*, 15*c*, 15*d*, 15*e*, 15*f*.

The first wire harness 13 composed of an FPC is lighter in weight than a wire harness with normal electric wires being bundled and also, the space necessary for wiring the first wire harness 13 itself is less.

The harness 13 is extended through hole portions 16*a* through 16*f*, hole portions 17*a* through 17*f* with a pitch S in the widthwise direction, at an interval R in the lengthwise direction, so that it may oppose the pressure contact terminal inserting hole 20*e* of the branch connector 10 to be described later, in the lead wire portion 15 in a portion for mounting the branch connector 10 of the first wire harness 13. The circuit contact portion 25*c* at the tip end of the pressure contact terminal 25 inserted into the pressure contact terminal inserting hole 20*e* is adapted to be projected onto the side of the bottom face 14*b* of the film 14.

The connector receiver 10 is composed of an upper case 20 and a lower case 21. Connectors 22 (22-I, 22-II, 22-III), mounted on the tip end of the above described branch wire group 12, are detachably inserted into the above described upper case 20.

The connector receivers 10 are disposed at proper intervals P, P' in optional positions of the branch circuit on the first wire harness 13 and the intervals P, P' are not equal to each other. A lower case 21 of the above described branch connector 10 is secured to the proper mounting portion of the car body with the use of fastening means (not shown) and so on inserted into a tapped hole 23*a* of a mounting portion 23 extended at its one end. The first wire harness 13 is grasped between the upper case 20 and the lower case 21 so as to fix the first wire harness 13 along the car body.

The above described connector 22 is detachably inserted, retained within the upper case 20 engaged with the lower case 21 as described hereinabove, the second wire harness 11 connected through a connector 22 and a branch wire group 12 is adapted to be retained in a set position.

The upper case 20 of the connector receiver 10 is provided with a rectangular, tubular outer frame 20*a* as shown. A hollow portion within the outer frame 20*a* is partitioned off with a bulkhead 20*b* with a connector inserting portion 20*c* being provided in the upper portion of the bulkhead portion 20*b*, with a pressure contact terminal inserting portion 20*d* being provided in the lower portion thereof.

A notch portion 20*f*, which is approximately the same in width as the above described first wire harness 13, is provided in the lower end portion in the lengthwise direction of the outer frame 20*a*.

Figure 8:
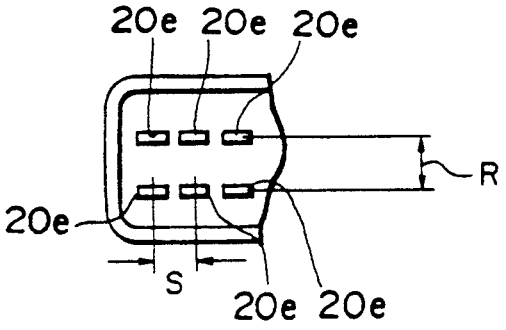
FIG. 8 is a partial plan view of an upper case.

A plurality of pressure contact terminal inserting holes 20*e* are extended through in parallel in two rows at a pitch S in the lengthwise direction and at an interval R in the widthwise direction in the above described bulkhead portion 20*b*, as shown in FIG. 8.

A connector lock portion 20*g* is formed on the inner wall of the connector inserting portion 20*c*. It is engaged detachably with a lock portion 22*a* formed on the connector 22 to be inside-engaged. The connector 22 is adapted to be locked within the connector inserting portion 20*c*. A lower case lock portion 20*h* is projected from the lower end with an interval being provided in the outer face of the outer frame 20*a*. It is detachably engaged with the lock portion 21*a* provided in the lower case 21, to be described later, so as to fix the upper case 20 with respect to the lower case 21. The above described lower case lock portion 20*h* is tapered so that it may be projected gradually upwardly from the lower end. A flat face 20*i* for engagement use is provided at the upper end.

Figure 6:
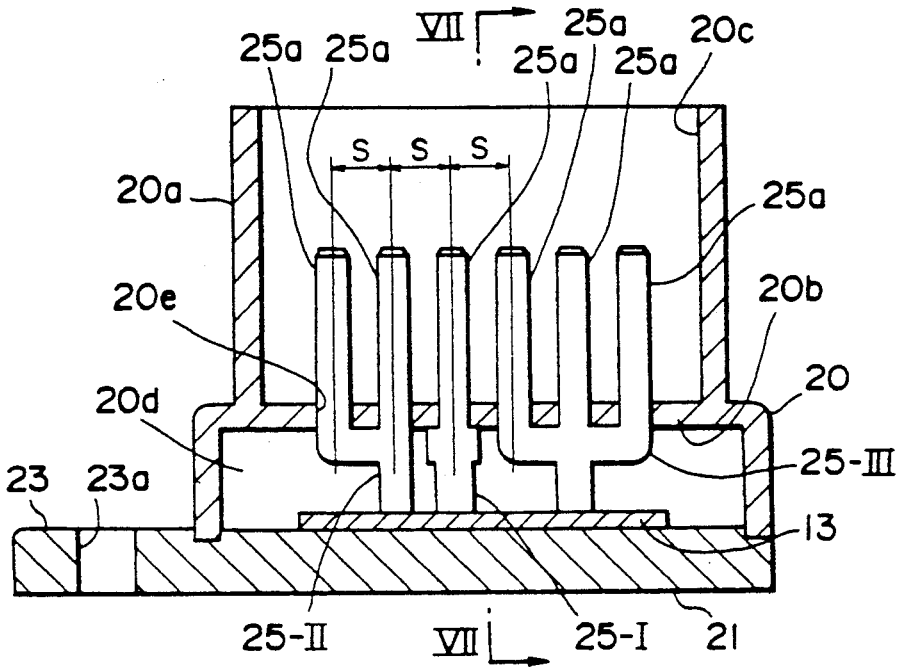
FIG. 6 is a sectional view showing a connector receiver in a first embodiment.
Figure 7:
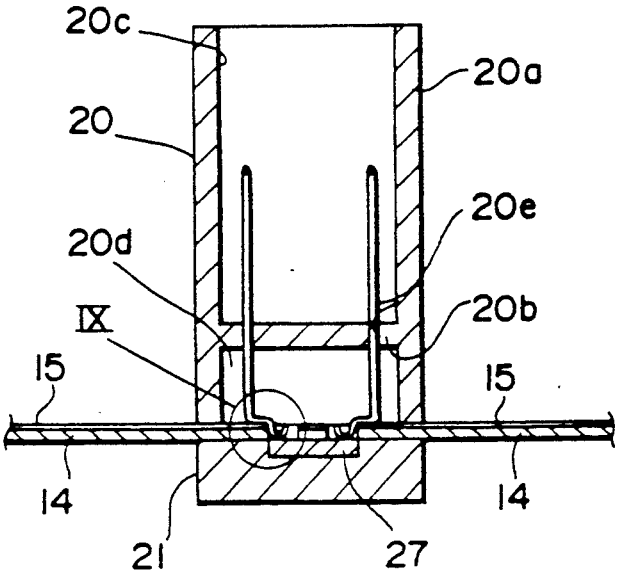
FIG. 7 is a sectional view taken along a line VII—VII of FIG. 6.

Three types of pressure contact terminals 25 (25-I, 25-II, 25-III) are inserted, as shown in FIG. 6, from the pressure contact terminal inserting portion 20*d* into the above described upper case 20. A single (single electrode) or a plurality of (plural electrodes) male shaped contact portions 25*a* provided on the upper side portion of each pressure contact terminal 25 are inserted into the above described pressure contact terminal inserting hole 20*e* and are projected into the connector inserting portion 20*c*.

The above described male shaped contact portion 25*a* is inserted into a pressure contact terminal inserting hole 20*e* formed at the above described pitch S and is set to be secured. The male shaped contact portion 25*a* is inserted into the female shaped contact portion (not shown) in a lower end opening formed in the connector 22 to be inserted into the connector inserting portion 20*c* so as to connect each electric wire of the branch wire group 12 with the pressure contact terminals 25.

Figure 9:
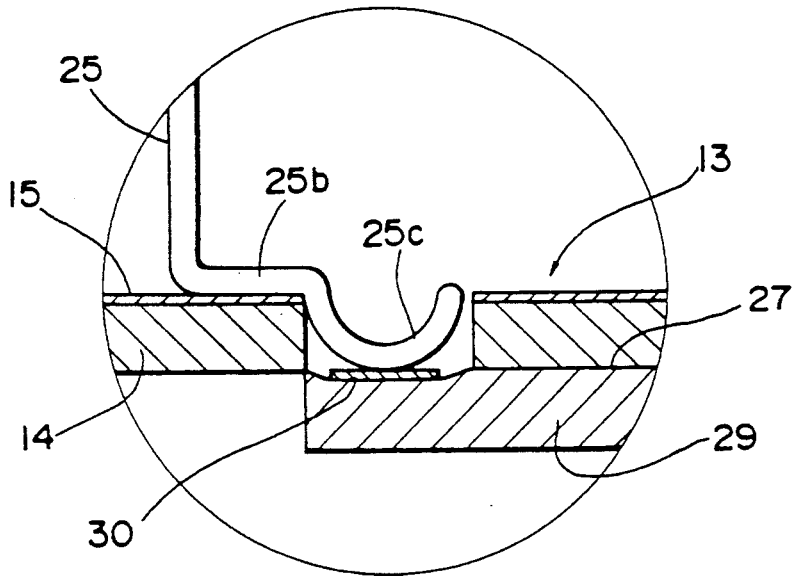
FIG. 9 is a partial expanded view of a IX portion of FIG. 7.
Figure 10:
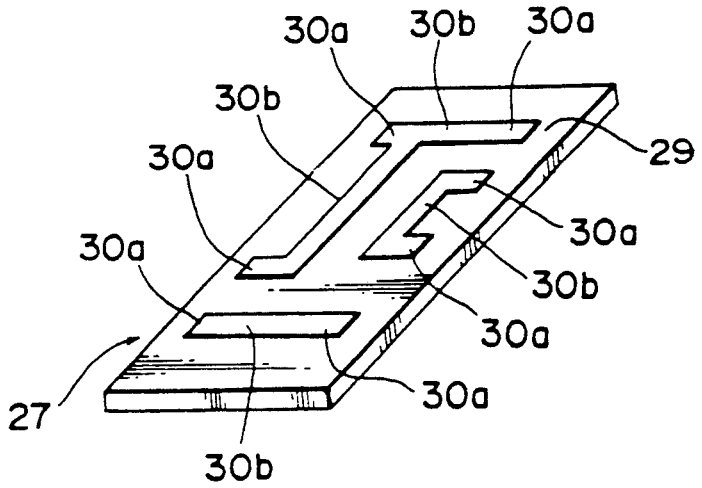
FIG. 10 is a perspective view showing a FPC for circuit construction use.
Figure 11:
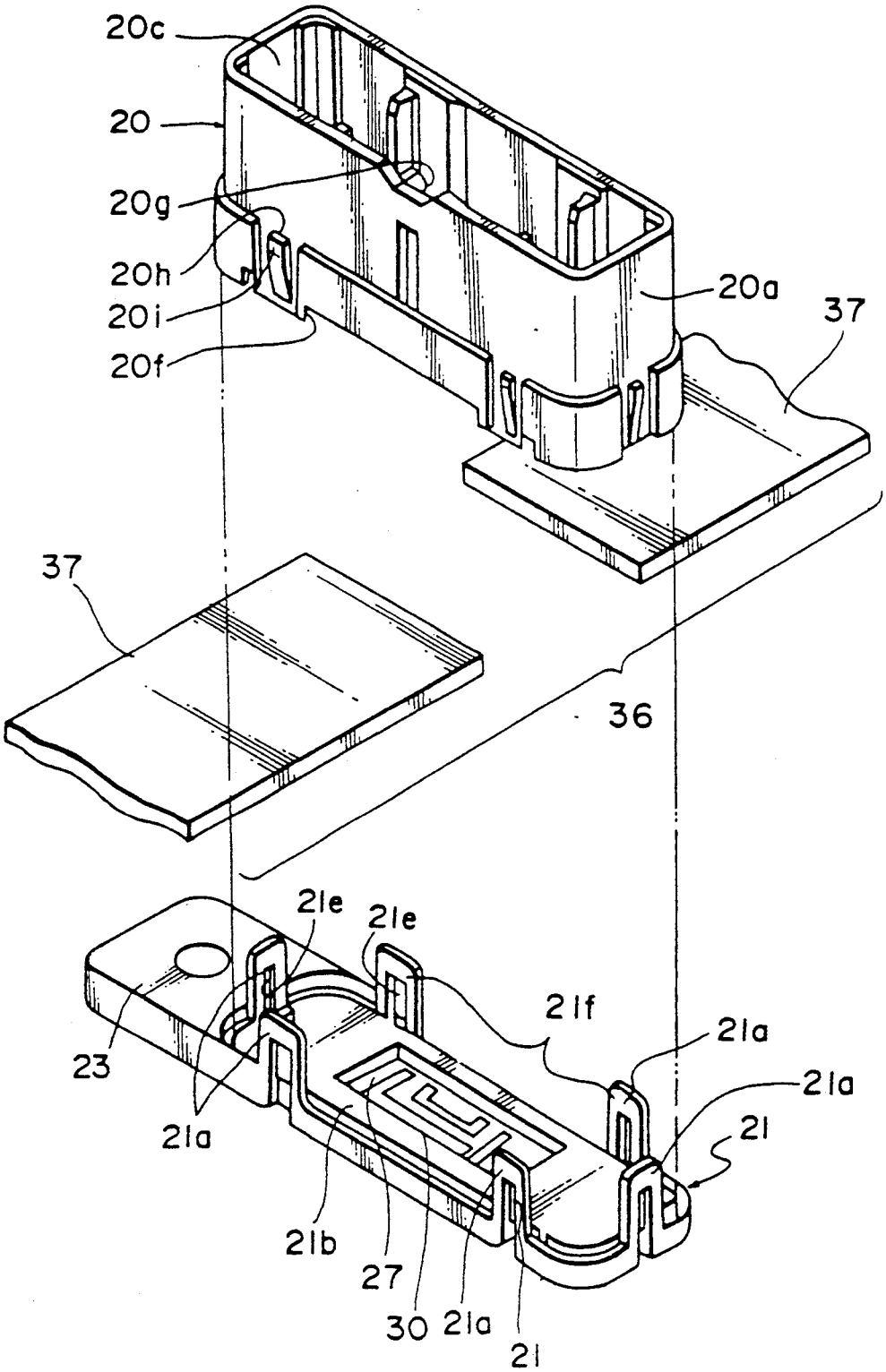
FIG. 11 is a perspective view of essential portions showing a second embodiment.
Figure 12:
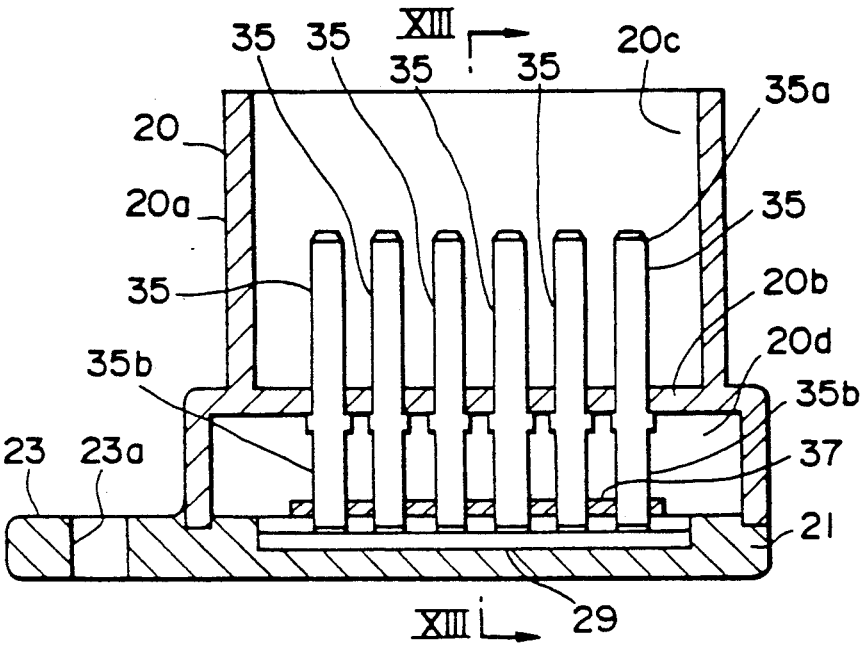
FIG. 12 is a sectional view showing a connector receiver of a second embodiment.
Figure 13:
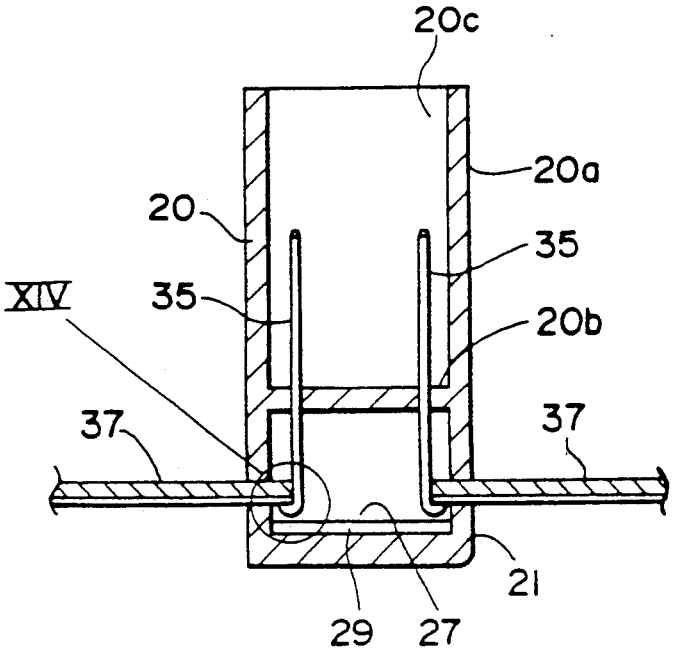
FIG. 13 is a sectional view taken along a line XIII—XIII of FIG. 12.

A connecting portion 25*b* bent on one side is provided in the lower side portion of each of the above described pressure contact terminals 25 (see FIG. 9). Furthermore, a circuit contact portion 25*c*, which is bent in a circular arc shape continuously up to the contact portion 25*b*, is provided.

A lead wire portion 15 is connected, with ultrasonic wave welding and so on, with the lower face of the above described connecting portion 25*b*, so that the branch wire group 12 of the second wire harness 11 is adapted to be connected with the lead portion 15 of the first wire harness 13 through the pressure contact terminal 25.

The contact portion 25*c* is projected onto the side of the lower face 14*b* of the film 14 from the hole portions 16, 17 of the above described first wire harness 13 to have conductivity in the terminal contact portion 30*a* of the circuit portion 30 of the circuit construction FPC 27 to be described later provided on the side of the lower case 21 for coming into contact. The circuit contact portion 25*c* may be elastically oscillated in the boundary portion with the connecting operation 25*b*, and the contact portion 25*c* is elastically depressed on the circuit portion 30 so that the contact portion 25*c* may be positively conducted to the circuit portion 30.

Figure 3:
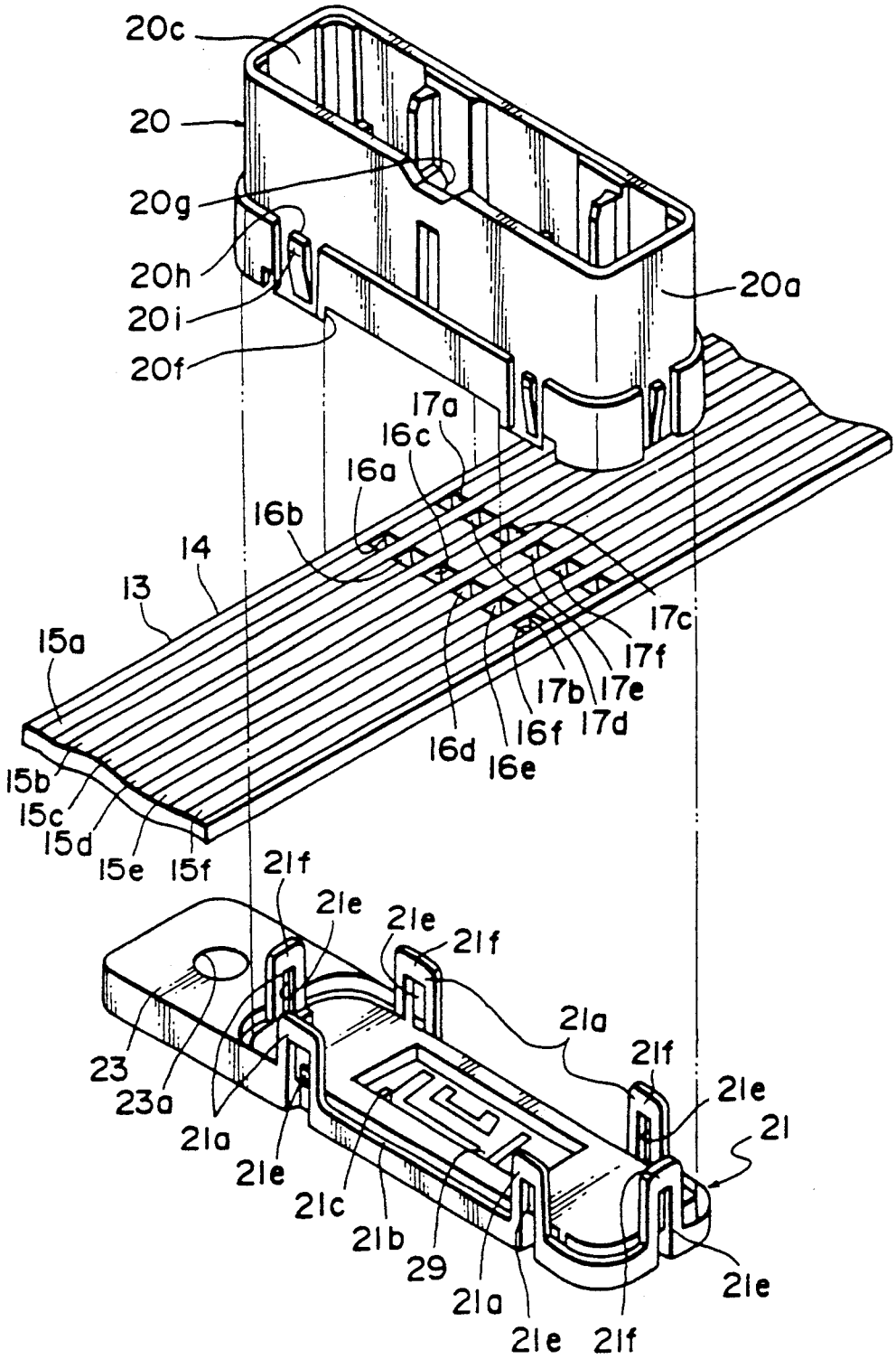
FIG. 3 is an exploded perspective view of the essential portions of FIG. 1.
Figure 4:
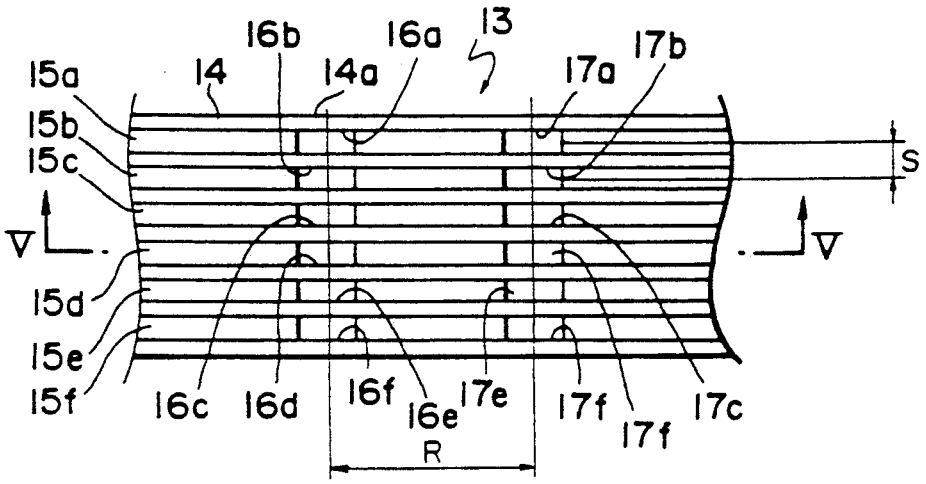
FIG. 4 is a plan view showing a first wire harness.
Figure 5:
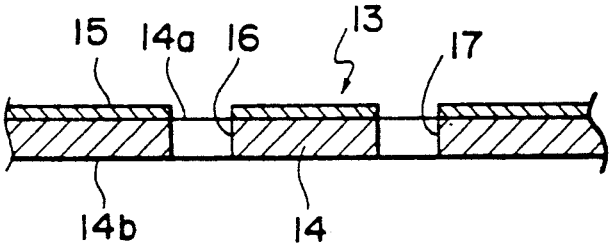
FIG. 5 is a sectional view taken along a line V—V of FIG. 4.

The lower case 21 engaged with the above described upper case 20 is approximately flat-shaped as shown in FIG. 3 and is shaped to close the lower end opening of the pressure contact terminal inserting portion 20*d* of the upper case 20. As described hereinabove, the car body mounting portion 23 with a tapped hole 23*a* being provided therein is extended from one end in the lengthwise direction.

A lock portion 21*a* to be engaged with the lower case lock portion 20*h* of the upper case 20 is projected from the top face 21*b* of the above described lower case 21, namely, the outer edge portion which becomes the bottom face portion of the pressure contact terminal inserting portion 20*d* of the upper case 20. The lock portion 21*a* locks the upper case 20 and the lower case 21 with each other, with a lower case lock portion 20*h* being engaged into the lock hole 21*e*, and an upper end edge 21*f* being engaged with the engaging flat face 20*i*.

A rectangular-shaped concave portion 21*c* is provided in the lengthwise direction in the top face 21*b* of the above described lower case 21 and a circuit construction FPC 27 is disposed in the bottom face of the concave portion 21*c*.

The circuit construction FPC 27 is formed with a circuit portion 30 composed of copper leaf being printed on a film 29 having a rectangular shape and being flexible. The film 29 and the circuit portion 30 are respectively the same in material quality as the film 14 of the first wire harness 13, and the lead portion 15.

The circuit portion 30 is composed of a terminal contact portion 30*a* disposed in accordance with positions corresponding to the hole portions 16, 17 of the first wire harness 13, so as to be connected with the circuit contact portion 25*c* of the pressure contact terminal 25, and a coupling portion 30*b* to be connected mutually with the other terminal contact portion 30*a* in accordance with the desired circuit construction.

As the film 29 of the above described circuit construction FPC 27 has such flexibility as described hereinabove, it becomes slightly depressed elastically when the circuit contact portion 25*c* of the pressure contact terminal 25 comes into depressing contact against the terminal contact portion 30*a* of the circuit portion 30, so that the circuit contact portion 25*c* and the terminal contact portion 30*a* are adapted to be positively conducted.

In a first embodiment, the electric wire of the second wire harness 11 is connected with the male shaped contact portion 25*a* of the pressure contact terminal 25 through the connector 22 as described hereinabove, the connecting portion 25*b* of the pressure contact terminal 25 is connected with the lead wire portion 15 of the first wire harness 13. The electric wire of the above described wire harness 11 is selectively connected with the lead portion 15 of the first wire harness 13, and also, the circuit contact portion 25*c* of the pressure contact terminal 25 is connected with the circuit contact portions 25*c* of the other pressure contact terminals 25 through a circuit portion 30 of the circuit construction FPC 27 so as to form a branching circuit.

In order to form a branching circuit with the electric wire in the second wire harness 11 mutually connected with the lead wire portion 15 of the first wire harness 13, hole portions 16, 17 are provided in required positions necessary for the branching of the second wire harness 13, and also, the lower case 21 is secured in accordance to the position. The upper case 20 is engaged with the lower case 21 with the pressure contact terminal 25 being inserted into the necessary upper case 20, and the first wire harness 13 being disposed in the notch portion 20*f* of the upper case 20. A connector 22, mounted at the tip end of one branch wire group 12 branched from the second wire harness 11 with respect to the upper case 20, is inserted into the connector inserting portion 20*c* so as to effect locking operation.

By the above described step, the electric wire in the second wire harness 11 is mutually connected with the lead wire portion 15 of the first wire harness 13, so that the branching circuit is formed. In the first embodiment, since the branch connector can be disposed adjacent to the connecting electric wiring parts, extra electric wires are then unnecessary on the side of the second wire harness 11.

In the first embodiment, the circuit construction FPC 27 is replaced by a circuit construction FPC with a circuit portion of different construction being formed so as to change the circuit contact portion 25c of the other pressure contact terminal 25 to be connected with the circuit contact portion 25c of one pressure contact terminal 25 so that the circuit construction of the branch connector 10 can be easily changed.

A second embodiment of the present invention is shown in FIG. 11 through FIG. 14.

A pressure contact terminal 35 in the second embodiment is not branched in the tip end portion as in the pressure contact terminal 25-I of the above described first embodiment, and is provided with one tip end portion 35b with respect to one male shaped contact portion 35a.

Figure 14:
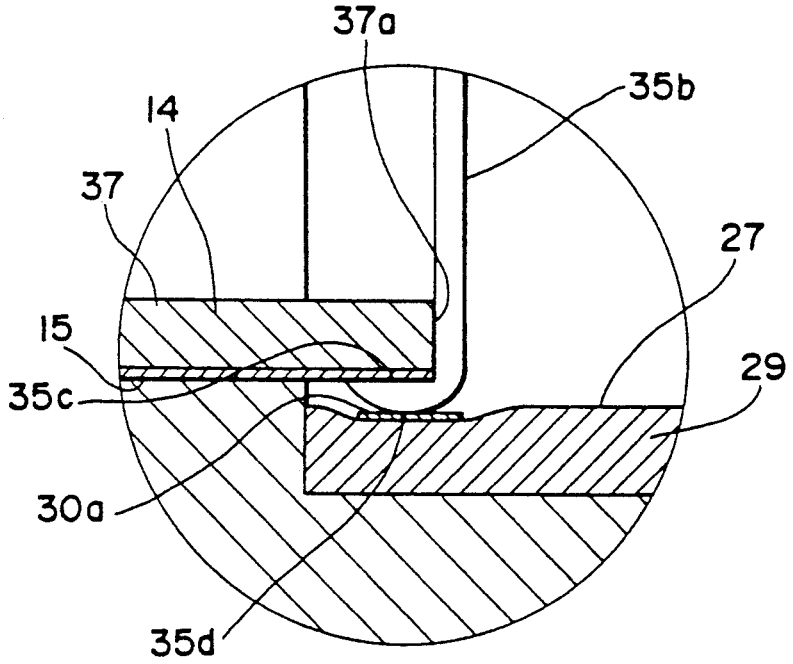
FIG. 14 is a partial expanded view of a XIV portion of FIG. 13.

As shown in FIG. 14, the tip end portion 35b of the above described pressure contact terminal 35 is formed semicircular in cross section. The flat portion on the top side in FIG. 14 forms a connecting portion 35c to be connected with the lead wire portion 15 of the first wire harness 36. The circular face on the lower side forms a circuit contact portion 35d to be connected with the circuit portion 30 of the circuit construction FPC 27.

In the second embodiment, in the first wire harness 36, such an elongated FPC as in the wire harness 13 in the above described first embodiment is adapted to be divided along its length corresponding to the interval of each branch connector 10. The space between respective branch connectors 10 is adapted to be connected with a section of the wire harness 37 having a length corresponding to the interval.

In each branch connector 10, a pair of wire harness section 37, each having a face with a lead wire portion 15 printed on it, are directed onto the side of the lower case 21 and are disposed so as to oppose each other, with the tip end portions 37a each being projected towards the inner portion side of the lower case 21 from the hole portions 21f of the lower case 21. Further, the end portions of wire harness section 37 are fixedly grasped between the top face 21b of the lower case 21 and the notch portion 20f of the upper case 20.

The lead wire portion 15 of the above described sectional wire harness 37 is connected with the connecting portion 35c of the pressure contact terminal 35, while the the circuit contact portion 35d is connected through contact with the terminal contact portion 30a of the circuit construction FPC 29.

In the second embodiment, the pressure contact terminal 35 is provided with one circuit contact portion 35d with respect to one male shaped contact portion 35a (i.e., unbranched). In accordance with the desired circuit construction, each pressure contact terminal 35 is connected only with the other remaining pressure contact terminals 35 through the circuit portion 30 of the circuit construction FPC 29 so as to form the circuit construction in the branch connection.

As the second embodiment is similar in the other construction and the operation to the above described first embodiment, like parts are designated by like reference numerals throughout the accompanying drawings.

FIG. 15 through FIG. 18 show a third embodiment of the present invention.

Figure 15:
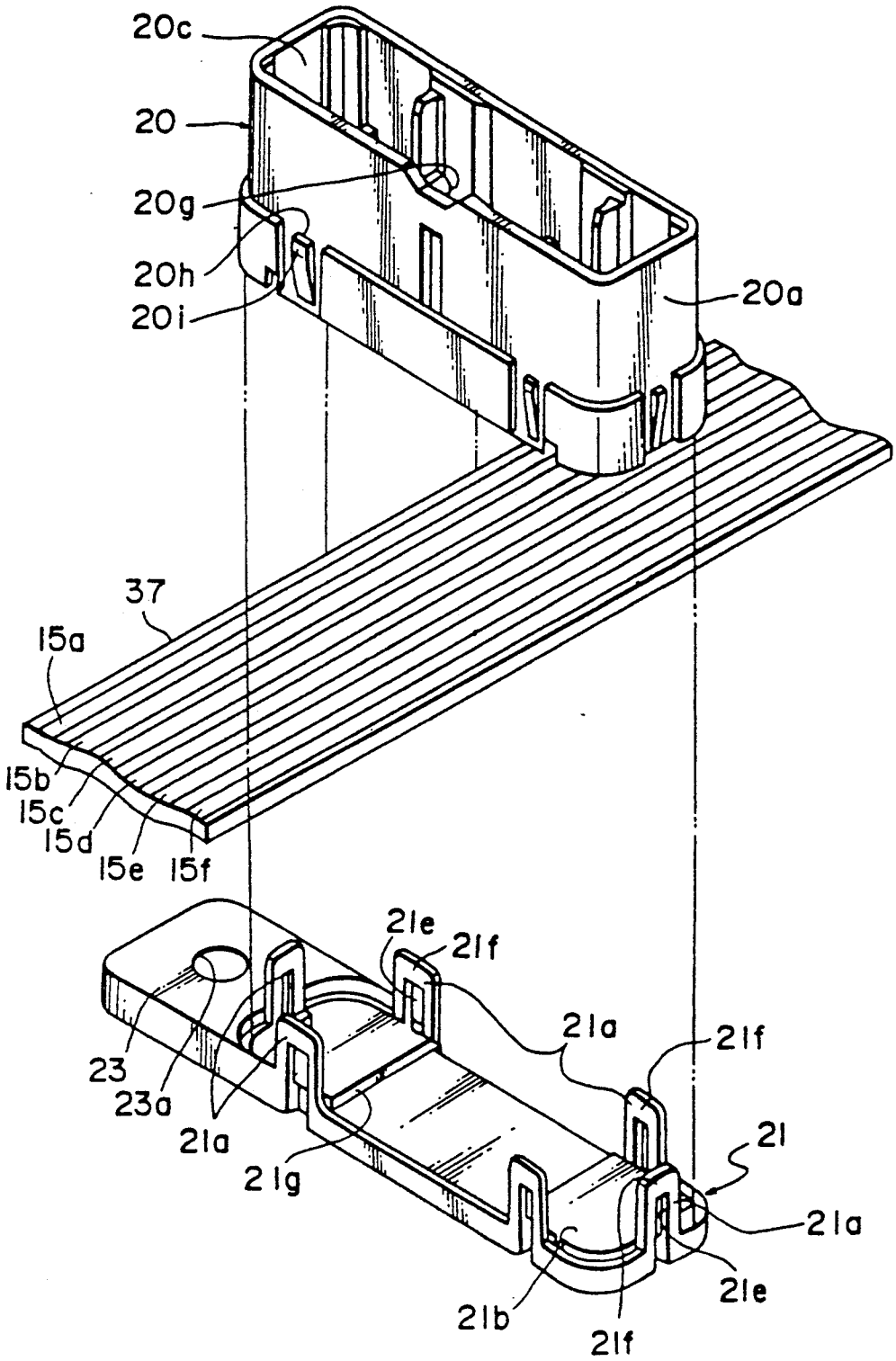
FIG. 15 is an exploded perspective view of the essential portions showing a third embodiment.
Figure 16:
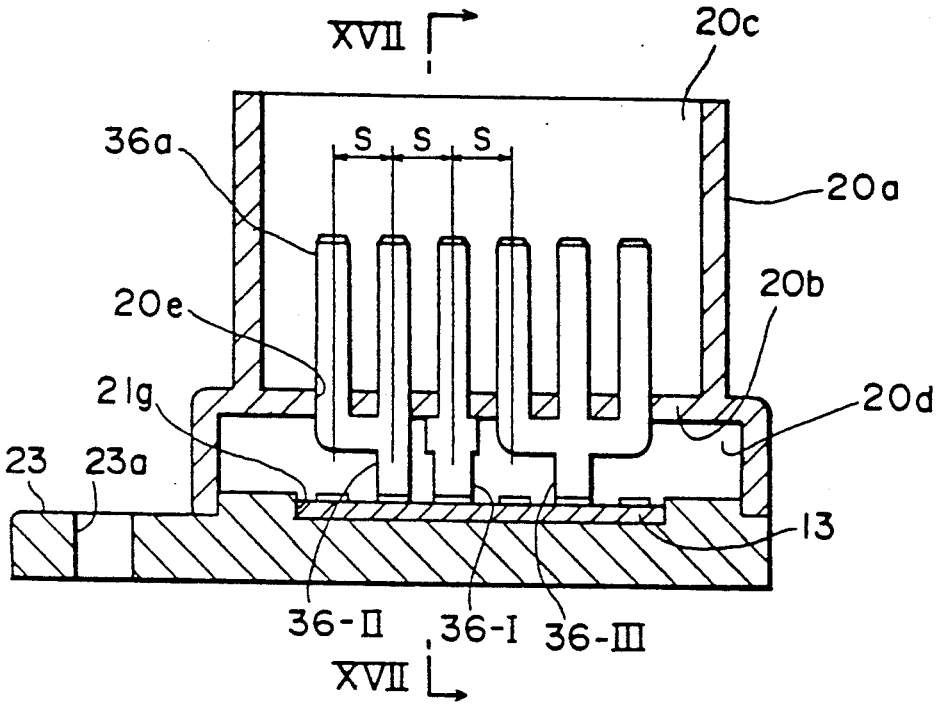
FIG. 16 is a sectional view showing a connector receiver of a third embodiment.
Figure 17:
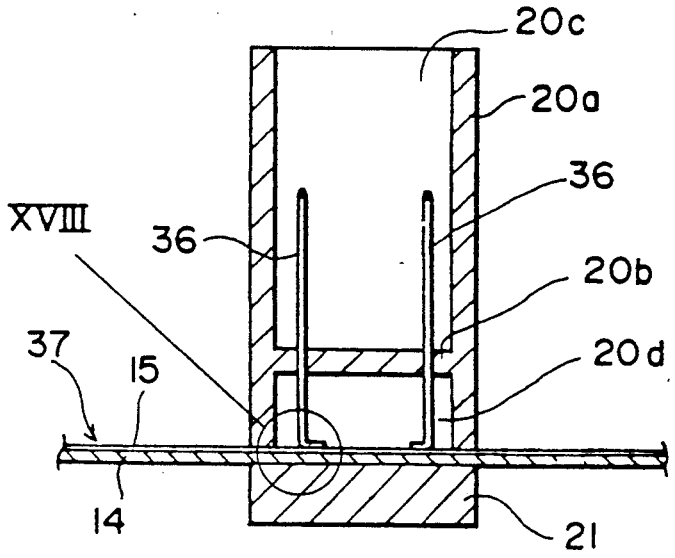
FIG. 17 is a sectional view taken along a line XVII—XVII of FIG. 16.
Figure 18:
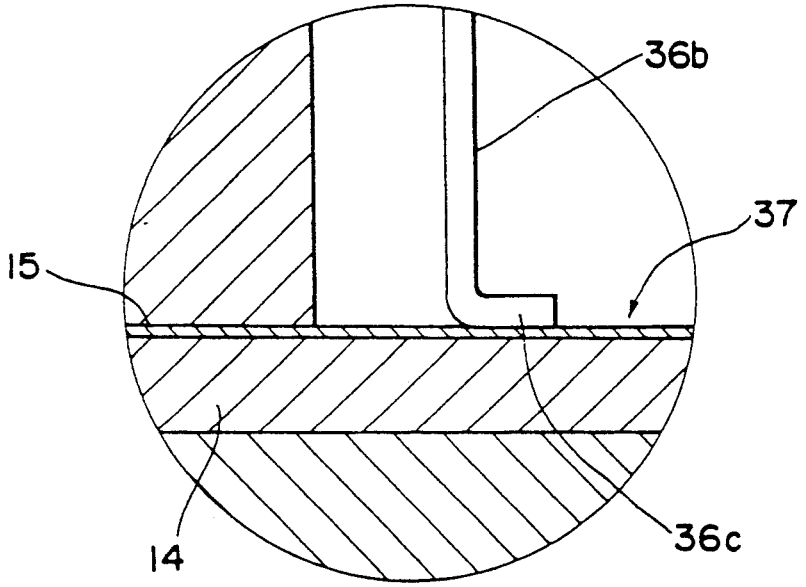
FIG. 18 is a partial expanded view of a XVIII portion of FIG. 17.

In the third embodiment, a circuit, construction FPC is not disposed in the lower case 21 as shown in FIG. 15. The circuit within the branch connector 10 is composed only with the pressure contact terminal 36.

In the third embodiment, three types of pressure contact terminals 36-I, 36-II, 36-III with the number of the tip end portions 36b corresponding to one male shaped contact portion 36a being different, are provided as in the above described first embodiment. A connecting portion 36c bent on one side is provided at the tip end portion 36b of the pressure contact terminal 36, with the lower face of the connecting portion 36c being connected with the lead wire portion 15 with ultrasonic wave welding and so on.

The first wire harness 37 is adapted to be continuous, as in the above described first embodiment, and is not provided with hole portions.

A rectangular-shaped (in section) guide groove 21g, which is approximately the same in width as in the first wire harness 37 in the widthwise direction, is provided in the central portion on the top face of the lower case 21. The portion of the first wire harness 37 located between the guide groove 21g and the lower portion of the upper case 20 is grasped with a face having the lead wire portion 15 printed on it being directed upwards, and the first wire harness 37 is adapted to be secured onto the branch connector 10.

As the third embodiment is adapted to be constructed as described hereinabove, the electric wire of the second wire harness 11 connected with the male shaped connecting portion 36a of the pressure contact terminal 36 is connected with the desired lead wire portion 15 of the first wire harness 37 through the pressure contact terminal 36 so as to form the circuit construction of the branch connector 10.

Figure 19:
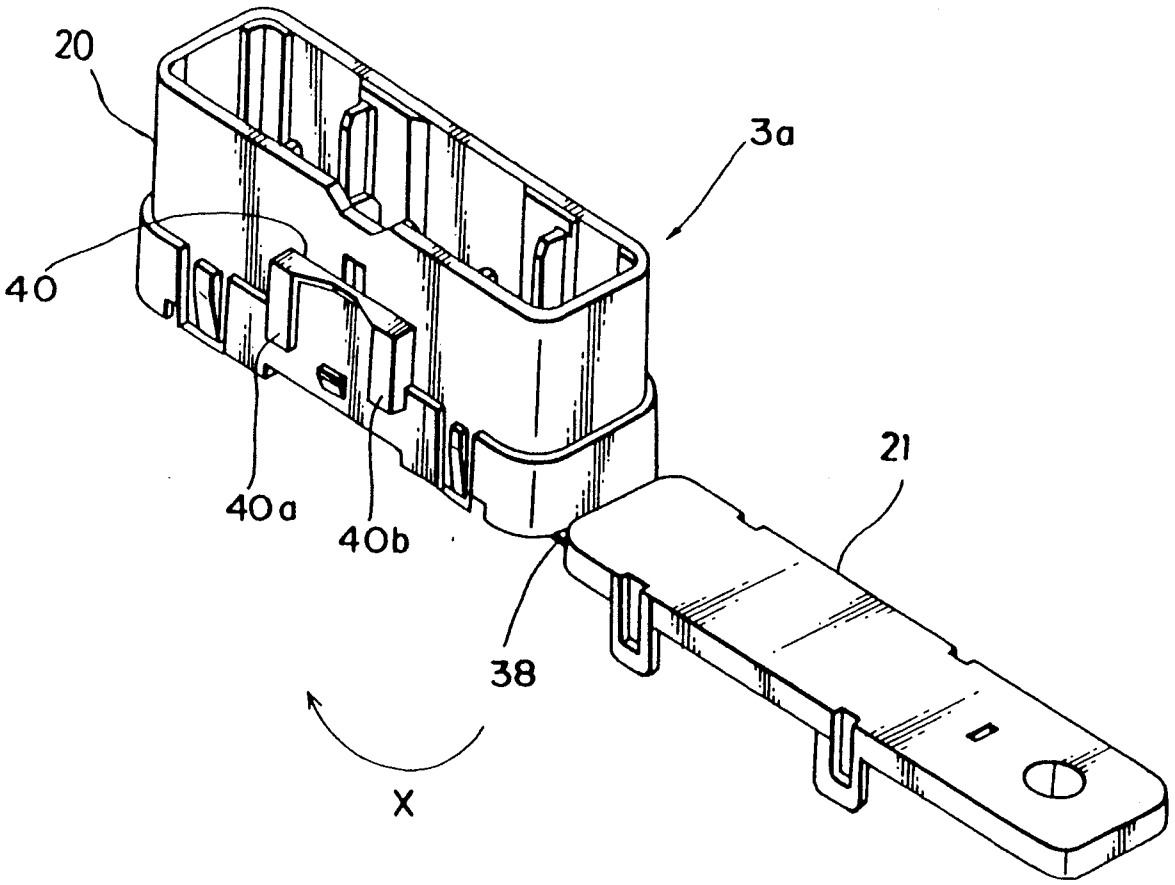
FIG. 19 is a perspective view of the essential portions showing a fourth embodiment.
Figure 20:
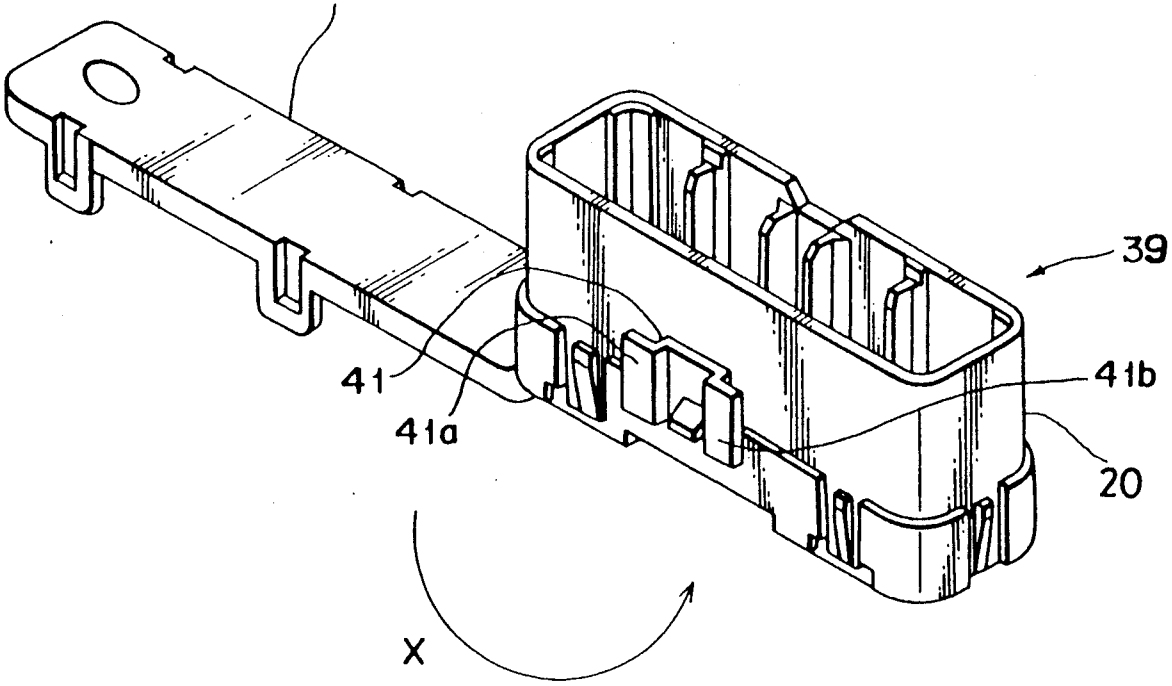
FIG. 20 is a perspective view of the essential portions showing a fourth embodiment.

FIG. 19 and FIG. 20 show a fourth embodiment of the present invention. In the fourth embodiment, the short, side portions of the upper case 20 and the lower case 21 are formed integrally through a hinge portion 38 having flexibility, and are provided as a case 39 composed of one member.

The above described upper case 20 and lower case 21 are shaped as in the above described first embodiment. The lower case 21 is connected with the upper case 20 through the hinge portion 38, with the face having the circuit construction FPC so as to be disposed being directed downwards as shown.

The above described hinge portion 38 is thin and flexible. The open, lower end portion of the upper case 20 can be closed by 180 degree rotation of the lower case 21, as shown with an arrow X.

In the fourth embodiment, the upper case 20 is integrally formed with the lower case 21 so that the steps at the time of assembly can be reduced and, also, the number of parts can be reduced.

In the fourth embodiment, a first coupling portion is provided on the outer face on one of the long sides of the outer frame 20a of the upper case 20, and a second coupling portion 41 is provided on the outer face on the other long side.

Two connector receivers 10 can be coupled together in a condition of being mutually detachably locked with both the side pawls 41a, 41b of a seconding coupling portion 41 being engaged with both side cover portions 40a, 40b of the first coupling portion 40.

In the fourth embodiment, connector receivers 10 to be adjacently disposed can be coupled to each other by as desired. In a situation where it is preferable to dispose the conventional joint block with connectors being concentratively accommodated in one case, the construction can be made similar to the joint block.

In the fourth embodiment, the formation can be effected as the joint block of the connector in a location where the space is sufficient. The number of the connectors may be increased or reduced so as to easily cope with the situation during a design change where there is an increase or decrease the branch circuit number.

The present invention is not restricted to the above described embodiment, and is capable of various modifications.

For example, in the above described embodiment, the second wire harness is a normal type of wire harness with electric wires being bundled and may be composed of FPC as in the first wire harness.

Figure 21:
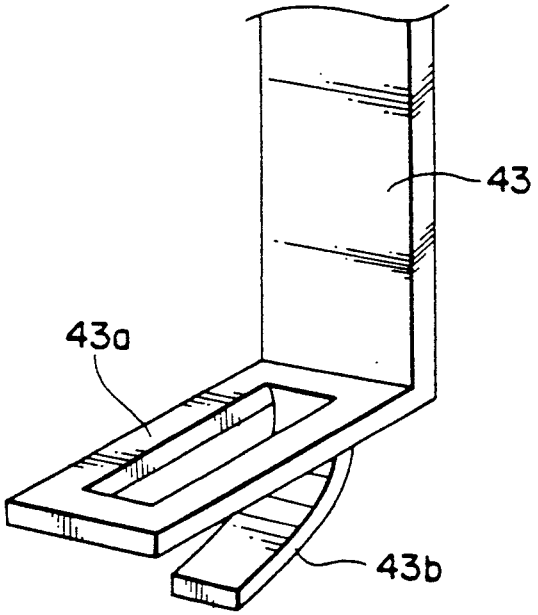
FIG. 21 is a partial perspective view showing the other embodiment of a pressure contact terminal.
Figure 22:
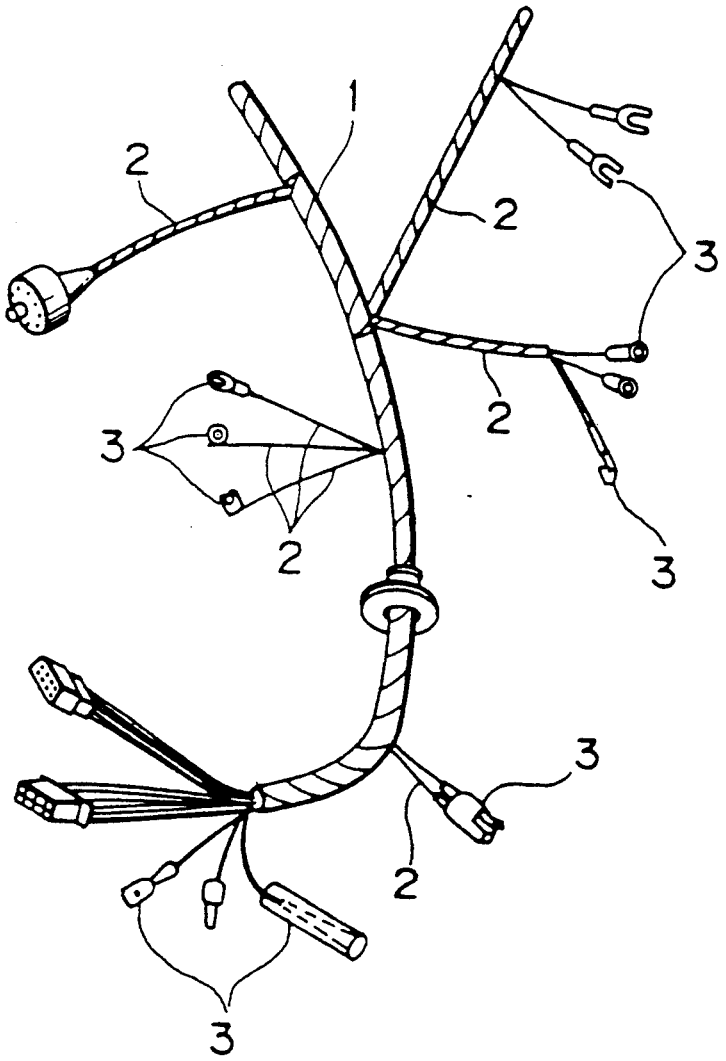
FIG. 22 is a schematic perspective view showing an embodiment of the conventional wire harness.

The shape of the tip end portion of the pressure contact terminal is not restricted to the above described embodiment. For example, a tip end portion is bent like the constant pressure terminal 43 as shown in FIG. 21 to provide a flat portion 43*a*, and also, a tongue shaped portion 43*b*, with the flat portion 43*a* being bent downwards with an undercut being provided from the tip end side, is provided. The first wire harness is connected onto the top face or the bottom face of the flat portion 43*a* so as to connect the lower face of the tongue shaped portion 43*b* to the circuit construction FPC.

As is clear from the foregoing description, according to the arrangement of the present invention, the FPC can be used for the wire harness in the branch connector in accordance with the present invention, thereby resulting in a light weight wire harness, and the required space of the wire harness itself can be reduced.

As the joint block, with the branching circuit being concentrated through the concentration of the connectors, is divided into a signal connector, the position for pulling out the branch wire group from the above desired first wire harness is dispersed. The restriction of the car body mounting space can be reduced the degree of freedom in the wire harness wiring can be increased by the smaller size of the branch connector.

When the circuit construction FPC is disposed in the lower case as described hereinabove so as to construct the circuit in the branch connector by the circuit construction FPC only, or by the circuit construction FPC and the pressure contact terminal, the above described circuit construction can be changed by simply exchanging the circuit construction FPC with one having a different circuit portion being printed thereon.

The assembling operation can be simplified and also, the number of parts and the cost can be reduced when the lower case and the upper case are integrally connected through a hinge.

Also, when a coupling portion is provided in each branch connector, the branch connector can be dispersed, coupled when necessary, with various advantages that the degrees of freedom of the design in the wire harness can be further increased.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A branch connector comprising: at least a first wire harness composed of a flexible printed circuit, said first wire harness including a plurality of lead wire portions and a plurality of connector receivers; and a second wire harness having a single connector being mounted respectively at the tip ends of each of a plurality of branch line groups to be branched and taken out from optional positions along said second wire harness, wherein each of said connector receivers comprises:

a lower case for supporting said first wire harness and including a branching circuit secured therein;

an upper case which is detachably mounted on said lower case and is provided with a connector inserting portion into which a corresponding one of said single connectors is detachably inserted;

and a pressure contact terminal mounted on said upper case and having one portion thereof projecting into said connector inserting portion and connected with a corresponding one of said branch line groups of said second wire harness through said corresponding single connector, and an opposite portion thereof being connected with one of said lead wire portions of said first wire harness.

2. The branch connector as defined in claim 1, wherein said upper case further comprises an upper connector inserting portion and a lower pressure terminal inserting portion partitioned off by a bulkhead portion provided in a hollow portion of said upper case, said bulkhead portion having pressure contact terminal insertion holes drilled in parallel for receiving a plurality of pressure contact terminals, wherein each said pressure contact terminal includes a contact portion on a top portion of the pressure contact terminal and which is inserted into a corresponding one of the pressure contact terminal insertion holes so as to project into the connector inserting portion, said pressure contact terminal further including a tip end portion at a lower portion thereof and which is bent so as to form a connecting portion, said connecting portion being connected with one of the lead wire portions of the first wire harness to be grasped in a condition so as to be orthogonal to the corresponding pressure contact terminal insertion hole between said lower case and said upper case.

3. The branch connector as defined in claim 1, wherein said upper case further comprises an upper connector engagement portion and a lower pressure contact terminal inserting portion partitioned off by a bulkhead portion provided in a hollow portion of said upper case, said bulkhead portion having pressure contact terminal inserting holes drilled in parallel for receiving a plurality of pressure contact terminals, wherein said branching circuit comprises a flexible printed circuit disposed on a top face of said lower case, and wherein each said pressure contact terminal includes a contact portion on an upper portion thereof and which is inserted into a corresponding one of said pressure contact terminal inserting holes so as to project into said connector inserting portion, a connection portion which is connected with one of said lead wire portions of said first wire harness, and a circuit contact portion for contacting with a circuit portion of said branching circuit.

4. The branch connector as defined in claim 3, wherein said connection portion of each said pressure contact terminal comprises a bend tip end portion, and wherein said circuit contact portion is bent so that a lower side is convex-shaped and is continuous with said connecting portion, said connecting portion being connected with one of said lead wire portions of said first wire harness and disposed orthogonal to the corresponding pressure contact terminal insertion hole between said lower case and said upper case, said circuit contact portion projecting through a hole portion provided in said first wire harness and being guided into contact with the circuit portion of said branching circuit disposed on the top face of the lower case, such that one pressure contact terminal is connected with the other pressure contact terminals through the branching circuit.

5. The branch connector as defined in claim 3, wherein each pressure contact terminal has a pressure contact terminal inserting portion side including a top end having an upper side which forms a connecting portion composed of a flat face, said tip end having a lower side which forms a circuit contact portion composed of a peripheral face; and further wherein said first wire harness is divided into a plurality of first wire harness sections, such that a pair of first wire harness sections are grasped orthongonally to said pressure contact terminal inserting holes between the lower case and the upper case, whereby a corresponding one of said lead wire portions is connected with the connecting portion of the pressure contact terminal at an end portion of a corresponding first wire harness section so as to conduct the circuit contact portion of the corresponding pressure contact terminal into contact with the branching circuit disposed on the top face of the lower case, thereby to connect one pressure contact terminal with the other pressure contact terminals through the branching circuit.

* * * * *